United States Patent [19]

Reimann et al.

[11] 3,953,696

[45] Apr. 27, 1976

[54] ACTUATOR CONSTRUCTION HAVING RELEASABLE LOCK IN ACTUATED AND DEACTUATED POSITIONS

[75] Inventors: Christian Reimann, Rottweil; Hugo Weber, Gosheim; Ewald Ueth, Rietheim, all of Germany

[73] Assignee: J. & J. Marquardt, Germany

[22] Filed: July 12, 1974

[21] Appl. No.: 488,049

[30] Foreign Application Priority Data

July 14, 1973 Germany ..... 2335972

[52] U.S. Cl. ..... 200/157; 200/328

[51] Int. Cl.[2] ..... H01H 9/06

[58] Field of Search ..... 200/321, 322, 323, 324, 200/325, 328, 157

[56] References Cited

UNITED STATES PATENTS

| | | | |
|---|---|---|---|
| 1,929,662 | 10/1933 | Wappat | 200/157 |
| 3,662,136 | 5/1972 | Bienwald et al. | 200/157 |
| 3,746,815 | 7/1973 | Drummer | 200/328 |
| 3,847,233 | 11/1974 | Glover et al. | 200/159 R X |

*Primary Examiner*—Herman J. Hohauser
*Attorney, Agent, or Firm*—McGlew and Tuttle

[57] ABSTRACT

An actuator comprises a housing having a bore with an opening and having a recess stop surface defined along the bore. A push button actuator is displaceable in the bore and projects through the opening so that it may be moved by hand between a non-actuated position to an actuated position. The push button includes a cross-bore or cavity with a lock bolt movable in the cavity and biased by a spring so that it engages with the stop surface when the push button is in a deactivated position. The housing also has a crossbore or recess containing a release member which has a push button end which is engageable from the exterior of the housing to displace the release member. In the locked deactivated position, the release member is engaged with the locking member so that the displacement thereof forces the locking member against its biasing spring to a position in which it is moved out of engagement with the stop surface so that the push button may be moved to an activated position. In the activated position, the release member is engageable behind an extension on the push button so as to block the return movement of the push button and to hold it in an activated position. The push button may be moved against a biasing spring in the activated position to move the extension beyond the release member and cause the release member to move out of the way so that the push button may be returned to the deactivated position.

4 Claims, 3 Drawing Figures

ACTUATOR CONSTRUCTION HAVING RELEASABLE LOCK IN ACTUATED AND DEACTUATED POSITIONS

BACKGROUND OF THE INVENTION

1. Field of the Invention

This invention relates in general to the construction of an actuator or switch and, in particular, to a new and useful actuator having means for locking an actuator button in a deactivated position which may be easily released and which may also provide means for locking the actuator in an actuated position.

2. Description of the Prior Art

The present invention particularly relates to an actuator of the type which is adapted to be used with an electric hand tool. In this field, as in other similar fields, it is particularly disadvantageous if the actuator is capable of being actuated unintentionally, so that a tool or similar apparatus is switched on which may cause considerable damage. Thus, for example, a hand tool may be laid aside between two working operations and if the switch is actuated, for example, by the weight of the tool, the movement of the parts of the tool may cause considerable damage and possible injury. This is particularly serious in respect to a high speed power tool, such as an off-hand grinder, which might cause considerable damage if there were a possibility that the tool could be inadvertently turned on. On the other hand, it is also desirable that such tools may be simply and easily switched to an on position when desired.

SUMMARY OF THE INVENTION

In accordance with the present invention, there is provided an actuator or switch which is particularly constructed for an electric hand tool, but which is capable of easy operation but which will not permit actuation by mistake. The switch includes a button actuator which is locked in its off position and can be actuated only after release of a stop mechanism. In a particularly advantageous construction of the invention, a locking element is provided in the actuating mechanism which is movable transversely to the displacement direction of the actuating member. The locking element in the form of a bolt abuts against a stop surface located along the bore of a housing of the push button actuator. The construction includes a release member which is displaceable in a recess of the housing to move a locking bolt carried by the push button out of a position in which it is engaged with the stop surface so that the push button actuator is free to move to an actuated position. In addition, the same release member may be used to provide a blocking action against the movement of the push button actuator to an off position in order to keep the machine operating without pressure on the actuating button during long periods of operation. The safety mechanism offers 100% protection against involuntary and unintentional actuation of the switch since the actuating button cannot be displaced to an on position until a locking bolt is released by a release member.

The locking element is advantageously in the form of a lock bolt which is carried in a transverse bore of the push button itself and the bolt is biased by a spring in a direction to move out of the bore into a recess defined along the bore of the housing for the push button. The push button is returned to an off position by a return spring, and in this off position, the locking bolt moves downwardly into a recess of the housing along the bore to a position in which the locking bolt blocks the push button against movement in the actuation direction. The construction is such that the push button actuator is locked in the off position automatically. Preferably, the lock bolt is pushed against its biasing force into the accommodating cavity of the push button by means of a release member in the form of a detent which is displaceable transversely to the displacement direction of the push button actuator. The best solution is a construction in which the detent and the locking bolt are movable parallel to each other. They may be aligned directly with each other but, in a preferred variant of the invention, the detent is offset in position in front of the lock bolt in the displacement direction of the actuating member and the inner end of the detent applies against a recess formed in the locking bolt. The detent can be positioned in front of the lock bolt only so far as to permit a pushing down of the one by the other and, a return of the detent upon a displacement of the actuating member. The recess or cavity for the lock bolt is bounded by a surface which is in engagement with the inner end of the detent in the return direction of movement of the push button actuator. In consequence, the locking and unlocking is very effecting in both directions of movement. The push button actuator may be provided with one or more of such locking bolts in accordance with the design requirements. The release member may also be constructed so as to engage behind an extension of the push button actuator and block its return movement after it is first moved to an actuating position in order to hold the push button actuator in an actuated position for a period of time. The release member may be easily dislodged from engagement with the extension by pushing the actuator in the actuation direction for a small distance so as to permit the release member to be withdrawn out of engagement with the extension.

Accordingly, it is an object of the invention to provide an improved actuator, which includes a push button movable in a housing between activated and deactivated positions, and which includes means for locking the push button in a deactivated position and for holding it in an activated position.

A further object of the invention is to provide an actuator which is simple in design, rugged in construction and economical to manufacture.

For an understanding of the principles of the invention, reference is made to the following description of a typical embodiment thereof as illustrated in the accompanying drawing.

DESCRIPTION OF THE PREFERRED EMBODIMENT

Figure 1:
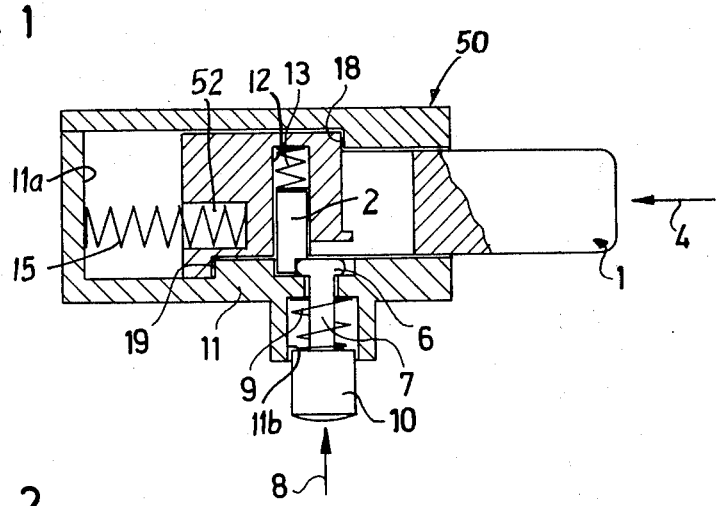
FIG. 1 is a longitudinal sectional view of an actuator constructed in accordance with the invention.

Referring to the drawings in particular, the invention embodied therein, comprises an actuator or switch, generally designated 50, which includes a housing 11 having a bore 17 which is opened at one end and which is also provided with a recess defining a stop surface 3 along bore 17. The actuator shown comprises an electric push button switch, for example, for an electric hand tool, such as an off-hand grinder or a hand drilling appliance. The actuator advantageously comprises a usual "on-off switch" and the electrical connections are not indicated but only the activated and deactivated positions of a push button actuator, generally designated 1.

In accordance with the invention, the push button actuator is provided with an off position stop lock in order to prevent an unintentional switching of the hand tool or the closing of an electric circuit. For this purpose, the push button 1 is provided with a transverse bore 1*a* having a lock bolt 2 movable therein. In the deactivated position or off position of push button 1, shown in FIG. 1, locking bolt 2 engages in a recess against a stop surface 3 and it prevents any movement of the push button actuator 1 to the actuated position in the direction of the arrow 4. The push button actuator 1 is returned to the deactuated position by the force of a return spring 15 which is advantageously a coil spring. One end of spring 15 abuts against an inner wall 11a of housing 11, and the opposite end is engaged in a cylindrical recess 52 at the inner end of push button actuator 1. In the deactivated position, shown in FIG. 1, the electrical contacts of the switch are open. The free end of lock bolt 2 is formed with a recess 5 on which an enlarged end 6 of a release member or detent 7 is engaged. The release member 7 can be pushed in the direction of the arrow 8 against the action of a return spring 9. Return spring 9 is advantageously a helical compression spring which surrounds the shaft of the locking member 7. The outwardly extending portion of locking member 7 includes a head or push button formation 10 which extends laterally out of the housing 11. The spring 9 is confined between the bottom end of head 10 and the switching housing walls at the inner end of a recess 11*b*. The lock bolt 2 moves perpendicularly to the actuating direction of movement of the push button actuator 1. Bolt 2 can be pushed backwardly against the action of its return spring 13 which is confined between the inner end of the bolt 2 and the inner end of the blind bore or cavity 12.

Figure 2:
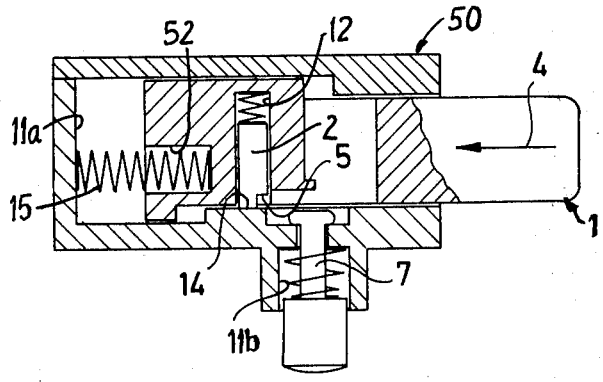
FIG. 2 is a view similar to FIG. 1 showing the actuator in an actuated position.

By means of release member 7, lock bolt 2 can be displaced in its blind bore 12, so that its free extremity will disengage from stop surface 3. In this displaced position of lock bolt 2, push button actuator 1 can be moved in the direction of the arrow 4 to the actuated position. Thereby, lock bolt 2 may be displaced away from release member 7 so that these two parts also disengage and release member 7 is returned to a retracted position as shown in FIGS. 1 and 2. During movement of the push button actuator 1, the free extremity of lock bolt 2 will ride over the surface 14 at the interior of bore 17. The intermediate position of push button actuator 1, which is before the final actuated position, is shown in FIG. 2.

Figure 3:
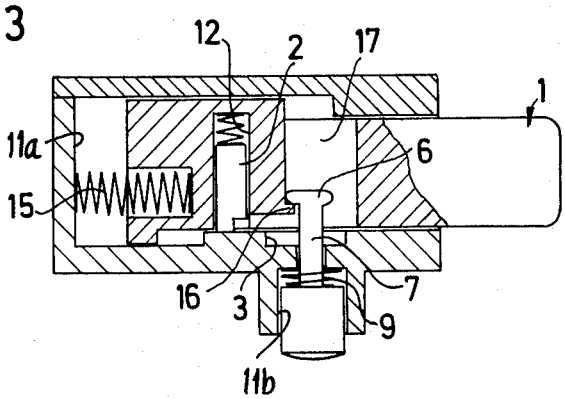
FIG. 3 is a view similar to FIG. 2 showing the actuator in an activated position and with the actuation lock mechanism engaged.

When it is desired that the tool operate for a long period of time, it is useful to provide means for locking the push button in its final on position. For this purpose, release member 7 is employed which may be displaced against its biasing spring 9 to position the widened end 6 behind an extension 16 of push button actuator 1. In this position, as shown in FIG. 3, it prevents the return movement of push button actuator 1. In order to unlock the push button actuator 1 so that it may be returned to a deactivated position, it is only necessary to push it first in an actuated direction, that is, the direction of arrow 4, for a slight displacement to cause the widened head portion 6 to move off the extension 16 and return to a non-blocking position. When push button actuator 1 is moved a slight amount in the direction of arrow 4 beyond the position shown in FIG. 3, the head 6 will disengage from extension 16 and spring 9 will return to a position at which it will not block the further movement of push button actuator 1. Thus a short touching of push button 1 is sufficient to release the return lock. When this is done, spring 15 then displaces push button actuator 1 back to a deactivated position and locking bolt 2 again moves into a locking position against stop surface 3. In the initial position, push button actuator 1 applies against shoulders 18 or 19 of the housing.

The switch may also be designed as a throw-over switch. Such a construction is useful in cases where an unintentional switching on of the device would be dangerous only in a second position of the push button actuator 1.

While a specific embodiment of the invention has been shown and described in detail to illustrate the application of the principles of the invention, it will be understood that the invention may be embodied otherwise without departing from such principles.

What is claimed is:

1. An actuator, comprising a housing having a housing bore with an opening, said housing having a stop surface along the bore, a push button actuator in the bore projecting through the opening and having a cavity, a lock bolt movable in the cavity and engaged in the deactivated position against said stop surface, lock bolt biasing means biasing said lock bolt into engagement with said stop surface, said housing having a recess, a release member movable in the housing recess and engageable with the locking bolt, said release member having a release button which projects out of the housing, said locking bolt being displaceable against said lock bolt biasing means out of engagement with the stop surface by said release member, said push button being displaceable along the housing bore to move to an actuated position when said locking bolt is disengaged from the stop surface, said actuator button including an extension, said extension being in a position in which it passes said release member when said actuating button is moved to an activated position, said release member being engageable behind said extension to block the return movement of said push button actuator.

2. An actuator, comprising a housing having a housing bore with an opening, said housing having a stop surface along the bore, a push button actuator in the bore projecting through the opening and having a cavity, a lock bolt movable in the cavity and engaged in the deactivated position against said stop surface, lock bolt biasing means biasing said lock bolt into engagement with said stop surface, said housing having a recess, a release member movable in the housing recess and engageable with the locking bolt, said release member having a release button which projects out of the housing, said locking bolt being displaceable against said lock bolt biasing means out of engagement with the stop surface by said release member, said push button being displaceable along the housing bore to move to an actuated position when said locking bolt is disengaged from the stop surface, said cavity of said push button actuator comprising a blind bore, said lock bolt comprising a bolt member slidable in said bore and a spring biasing said bolt member to move in a direction out of said bore.

3. An actuator, according to claim 1, including a spring biasing said actuator button to a deactivated position.

4. An actuator, comprising a housing having a housing bore with an opening, said housing having a stop surface along the bore, a push button actuator in the bore projecting through the opening and having a cavity, a lock bolt movable in the cavity and engaged in the deactivated position against said stop surface, lock bolt biasing means biasing said lock bolt into engagement with said stop surface, said housing having a recess, a release member movable in the housing recess and engageable with the locking bolt, said release member having a release button which projects out of the housing, said locking bolt being displaceable against said lock bolt biasing means out of engagement with the stop surface by said release member, said push button being displaceable along the housing bore to move to an actuated position when said locking bolt is disengaged from the stop surface, said bolt and said release member being movable in substantially parallel directions the cavity of said housing being a blind bore, said lock bolt biasing means comprising a spring between said lock bolt and the inner end of said blind bore.

* * * * *